US009725139B2

(12) United States Patent
Frabetti

(10) Patent No.: US 9,725,139 B2
(45) Date of Patent: Aug. 8, 2017

(54) BOAT WITH SUBMERSIBLE STERN HATCH

(71) Applicant: FERRETTI S.P.A., Cattolica (Rimini) (IT)

(72) Inventor: Andrea Frabetti, Zola Predosa (IT)

(73) Assignee: FERRETTI S.P.A., Cattolica (Rimini) (IT)

( * ) Notice: Subject to any disclaimer, the term of this patent is extended or adjusted under 35 U.S.C. 154(b) by 0 days.

(21) Appl. No.: 15/122,102

(22) PCT Filed: Mar. 3, 2015

(86) PCT No.: PCT/IB2015/051550
§ 371 (c)(1),
(2) Date: Aug. 26, 2016

(87) PCT Pub. No.: WO2015/132725
PCT Pub. Date: Sep. 11, 2015

(65) Prior Publication Data

US 2017/0066510 A1 Mar. 9, 2017

(30) Foreign Application Priority Data

Mar. 5, 2014 (IT) ..... MI2014A0339

(51) Int. Cl.
*B63B 17/00* (2006.01)
*B63B 27/14* (2006.01)
(Continued)

(52) U.S. Cl.
CPC ..... *B63B 27/14* (2013.01); *B63B 27/16* (2013.01); *B63B 27/36* (2013.01); *B63B 2019/086* (2013.01); *B63B 2029/022* (2013.01)

(58) Field of Classification Search
CPC ..... B63B 27/14; B63B 27/16; B63B 27/36
See application file for complete search history.

(56) References Cited

U.S. PATENT DOCUMENTS 4,953,492 A 9/1990 Duffty
5,579,711 A 12/1996 Thomas
(Continued)

FOREIGN PATENT DOCUMENTS

DE 4209090 A1 10/1992
EP 1122164 A2 8/2001
(Continued)

OTHER PUBLICATIONS

International Search Report and Written Opinion mailed Jun. 18, 2015 for PCT/IB2015/051550 to FERRETTI S.P.A. filed Mar. 3, 2015.

*Primary Examiner* — Stephen Avila
(74) *Attorney, Agent, or Firm* — Vorys, Sater, Seymour and Pease LLP

(57) ABSTRACT

A boat includes a hull provided with a rear stern hatch located in correspondence with an internal stern compartment of the hull and suitable for opening and closing in correspondence with an aperture of the compartment, the hatch having a body with opposed side located in correspondence with side walls of the compartment and upper edge and lower edge. The hatch includes an actuator to open and close the compartment arranged inside its own body, the actuator rotatably constraining at least one of the sides of the hatch to a support movable with respect to the stern of the hull and suitable for allowing the hatch to reach, upon opening, a position submerged in the water where the boat is, the body of the hatch being not provided with any further connections of the sides to the hull.

13 Claims, 14 Drawing Sheets

(51) Int. Cl.

| | |
|---|---|
| ***B63B 27/16*** | (2006.01) |
| ***B63B 27/36*** | (2006.01) |
| *B63B 19/08* | (2006.01) |
| *B63B 29/02* | (2006.01) |

(56) References Cited

U.S. PATENT DOCUMENTS

| | | | | |
|---|---|---|---|---|
| 6,792,886 | B1 | 9/2004 | Maloney et al. | |
| 9,168,981 | B2 * | 10/2015 | Ferretti | B63B 19/14 |
| 9,592,887 | B2 * | 3/2017 | Frabetti | B63B 27/143 |
| 2002/0134290 | A1 | 9/2002 | Armour | |
| 2006/0075952 | A1 | 4/2006 | Grimaldi | |
| 2010/0288179 | A1 | 11/2010 | Grimaldi | |
| 2013/0220207 | A1 * | 8/2013 | Mueller | B63B 27/146<br>114/362 |
| 2017/0015389 | A1 * | 1/2017 | Frabetti | B63B 19/08 |

FOREIGN PATENT DOCUMENTS

| | | | |
|---|---|---|---|
| EP | 2305553 | A1 | 4/2011 |
| EP | 2332820 | A1 | 6/2011 |
| FR | 2862273 | A1 | 5/2005 |
| WO | 2008135807 | A1 | 11/2008 |
| WO | 2011137548 | A2 | 11/2011 |
| WO | 2015132721 | A1 | 9/2015 |

* cited by examiner

BOAT WITH SUBMERSIBLE STERN HATCH

CROSS-REFERENCE TO RELATED APPLICATIONS

This is a §371 National Stage Application of International Application No. PCT/IB2015/051550 filed on Mar. 3, 2015, claiming the priority of Italian Patent Application No. MI2014A000339 filed on Mar. 5, 2014.

FIELD OF THE INVENTION

The object of the present invention is a boat according to the preamble of the main claim.

BACKGROUND OF THE INVENTION

Boats having a stern compartment provided with at least one closing stern hatch of its own are known for a long time. Such a compartment is used, for instance, to house a small boat or a tender. It is also known that in the stern portion, many prestigious boats have a stern platform determined by a projecting plane suitable for operating as a "small beach" for the boat's passengers.

With reference to said hatch, it can be moved with the purpose of freeing or closing an aperture to access the stern compartment (from the sea or from the stern platform). For this purpose, actuating members are usually provided, usually in the form of telescopic members which constrain the body of the hatch to side walls of the stern compartment.

The requirement is also known of allowing an easy submersion of the tender into the water and an easy recovery thereof into the hull. This is advantageously obtained by making the stern platform movable with respect to the hull and such as to make it possible to submerge it into the water on which the boat floats. This frees the access of the tender into the water and its picking up from the surface, for instance from the sea whenever the tender or dinghy is to be hauled in and put again in the hull. For this purpose, the platform is made movable, for instance, by means of telescopic systems supporting and constraining the platform to the hull which can bring said stern platform above the water surface or submerge it therein. In the first position, external to water, such platform can be used as a "small beach" on the rear side of the boat.

The presence of such stern platform offers comfort to the people on board the boat, a comfort that is directly proportional to the surface of the platform: the wider is it, the more is the "small beach" offered to such people. However, on the contrary, this is at odds with the need for having no rear or stern parts projecting from the hull in order to make its berthing in harbors easier. It follows that such platforms necessarily have reduced dimensions as to their extension from the hull.

US2006/0075952 and US2010/0288179 disclose a movable platform unit for a boat suitable for launching or hauling out a tender or similar water craft. Such unit comprises a base with a movable platform pivoted thereon and comprising a cavity for housing the movable platform. When in its closed position, i.e. when the platform is in said cavity, the platform precisely fits the overall shape of the base. The cavity houses a pair of fixed arms and swing arms are connected to distal ends of said fixed arms and can turn in a vertical plane perpendicular to the plane of the base of the platform unit. To the swing arms, a plurality of turnable steps are connected.

The distal ends of the swing arms are connected by a cross member also turnable about its longitudinal axis relative to the swing arms and a pair of supports is fixed one to each end of the cross member so as to be pivoted on the swing arm. Said supports are provided for mounting the movable platform.

These prior documents describe that the platform can be lowered beneath the surface of the water making it possible to launch or haul back on board a tender or similar craft associated with the boat, while the steps give swimmers easy access to the water.

SUMMARY OF THE INVENTION

The purpose of the present invention is to offer a boat that is enhanced with respect to the boats known at present.

Specifically, a purpose of the present invention is to offer a boat provided with a stern compartment enclosed by a hatch of its own in which it is simultaneously possible for the people on board the craft to benefit from a rear "small beach" featuring relatively remarkable dimensions, wider than those of the stern platform, and at the same time to make it possible a free movement of a tender or rubber dinghy, if any, from and inside said stern compartment toward and from the surface of the water on which the boat floats.

Another purpose is to offer a boat of the mentioned type that is easy to moor or whose stern can be approached to a pier in a way not hindered by the presence of an extended stern platform.

A further purpose is to offer a boat where the rear small beach has a large surface to lean on, with no elements jutting out or connecting to the hull, which would make its use by people on board the boat difficult or dangerous.

These purposes and others which will be apparent to those expert in this sector are achieved by a boat according to the attached claims.

BRIEF DESCRIPTION OF THE DRAWING

For a better understanding of the present invention the following drawings are attached for purely explanatory, not exhaustive, purposes, of which.

DETAILED DESCRIPTION OF THE PREFERRED EMBODIMENTS

Figure 1:
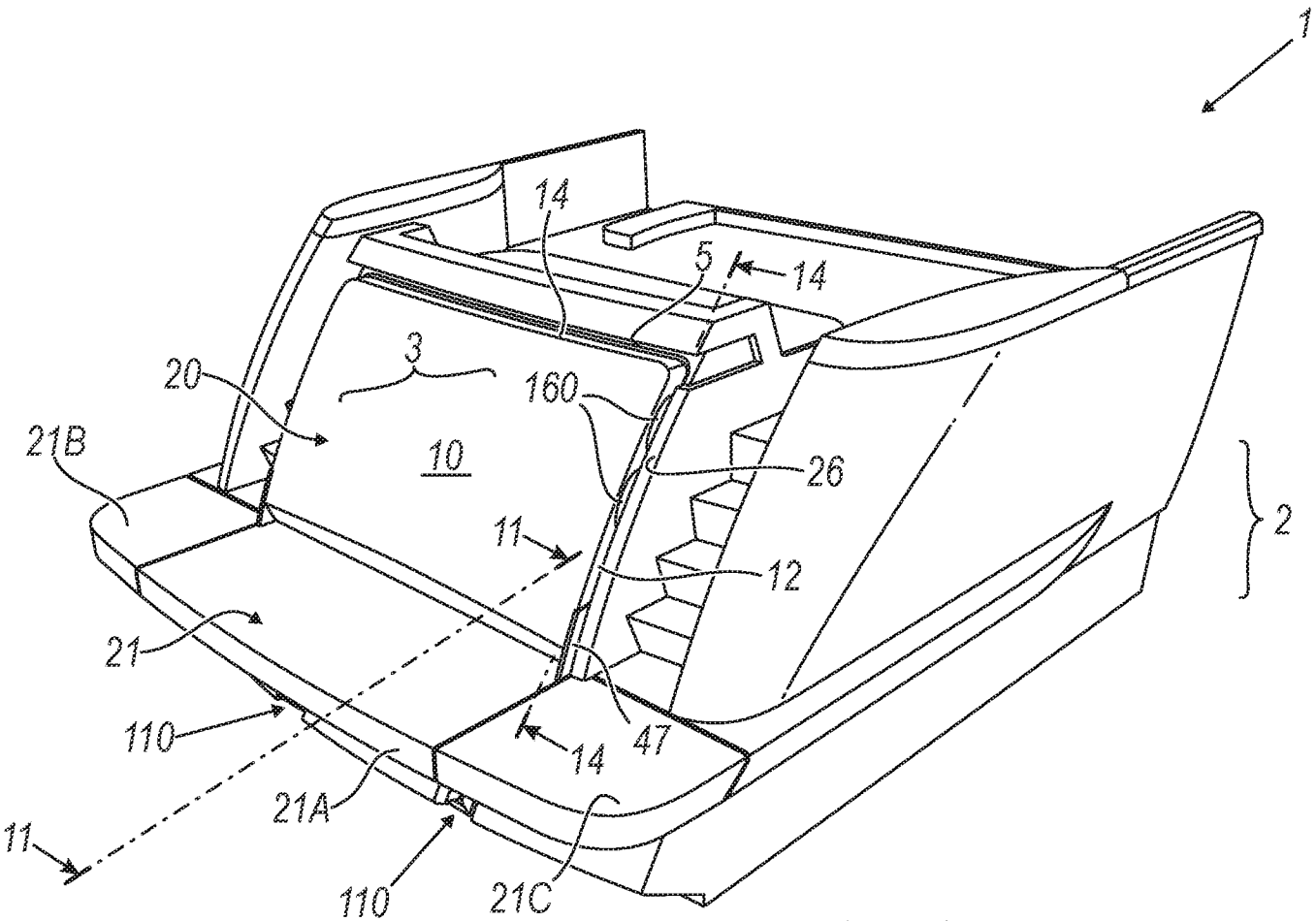
FIG. 1 shows the stern of a boat according to the invention, its stern hatch being closed.
Figure 2:
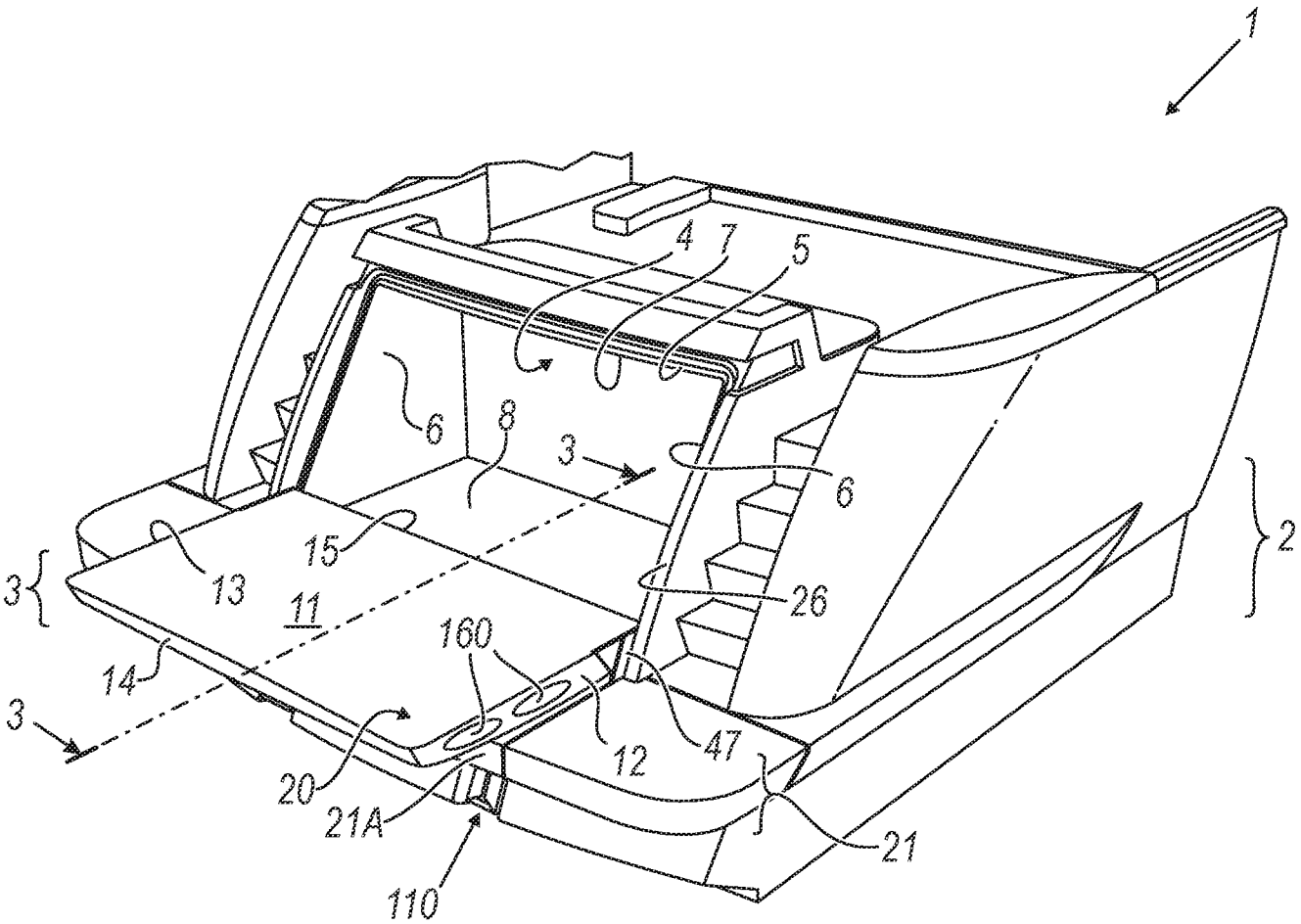
FIG. 2 shows the stern of the boat depicted in FIG. 1, its hatch being open downwards.
Figure 3:
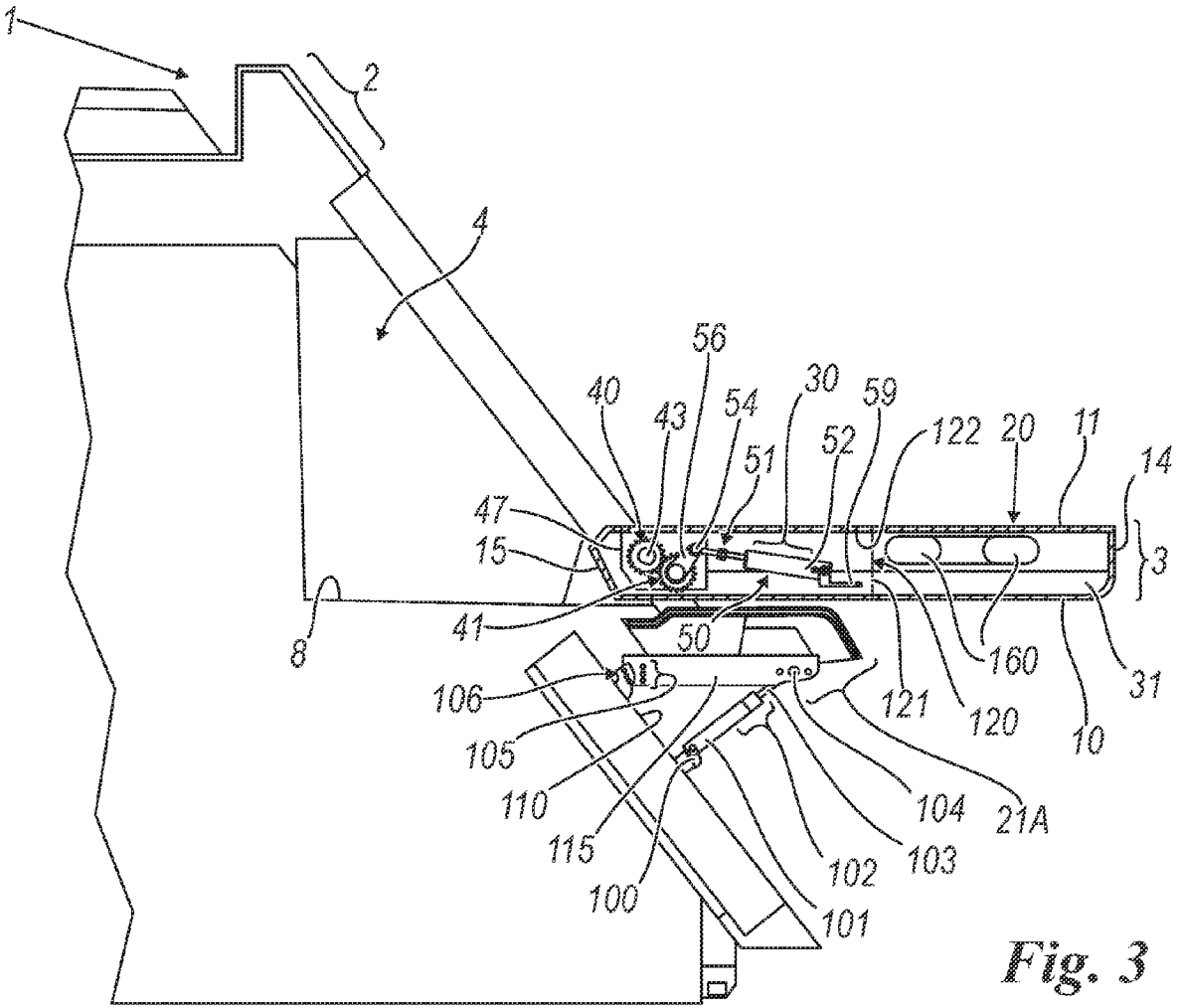
FIG. 3 shows a cross-sectional view according to the line 3-3 of FIG. 2.
Figure 4:
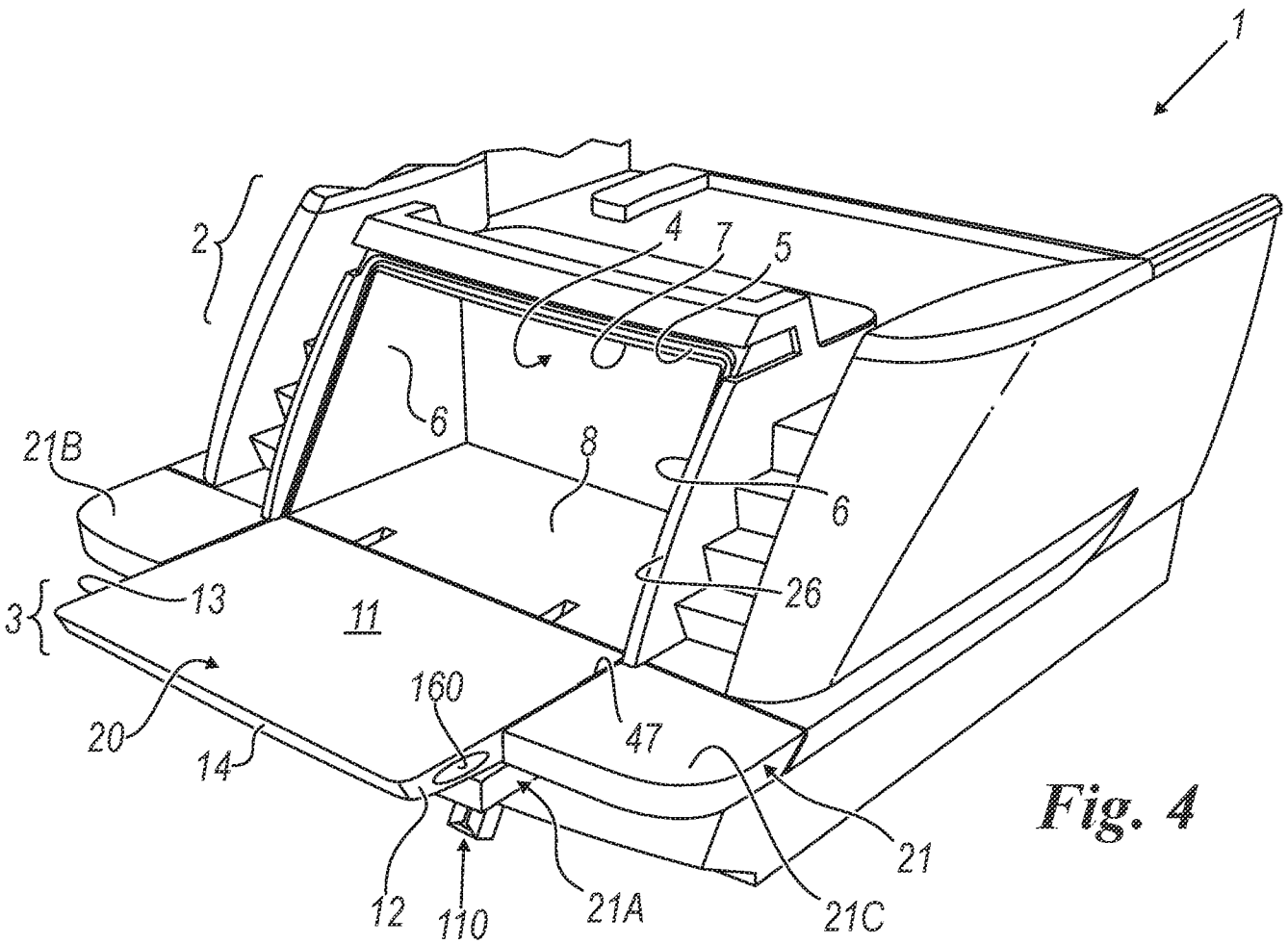
FIG. 4 shows the stern of the boat, its hatch being open and partially shifted toward the water on which the boat is floating and aligned to the plane of a stern platform of the boat.
Figure 5:
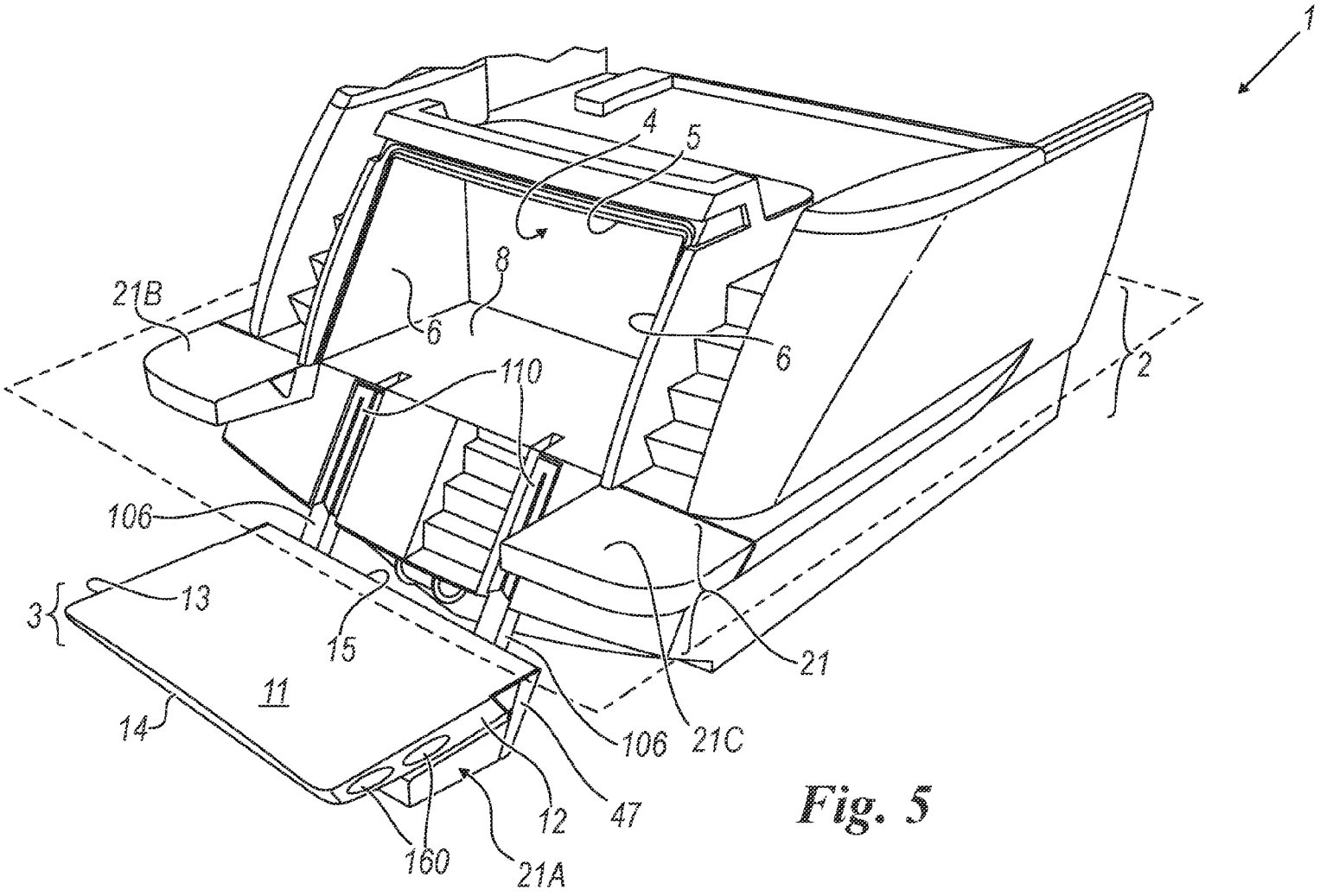
FIG. 5 shows a perspective view, from the stern, of the boat, its hatch being in a position whereby it is completely submerged in the water.
Figure 6:
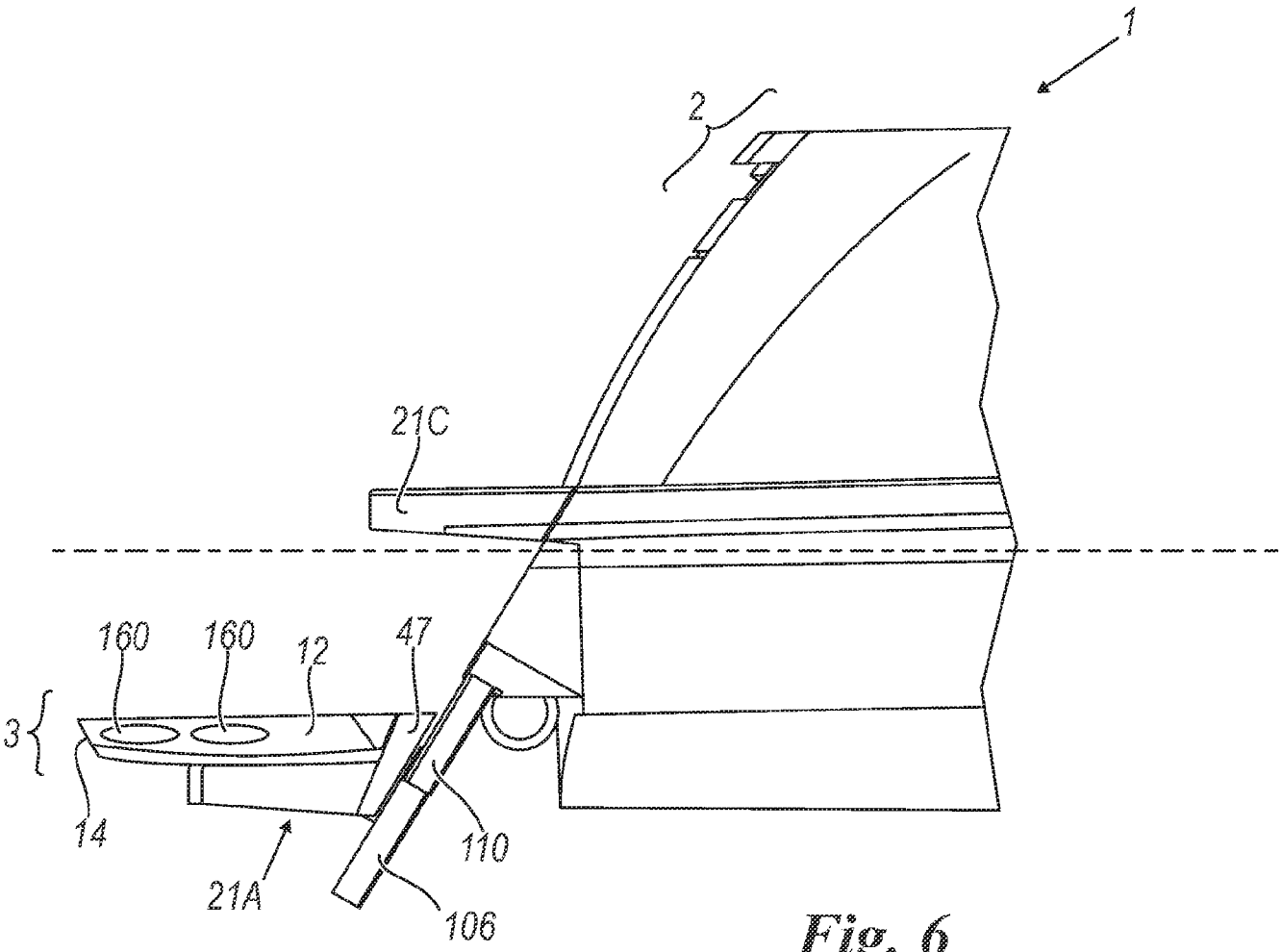
FIG. 6 shows a side view of the stern of the boat, its hatch being in the position depicted in FIG. 5.
Figure 7:
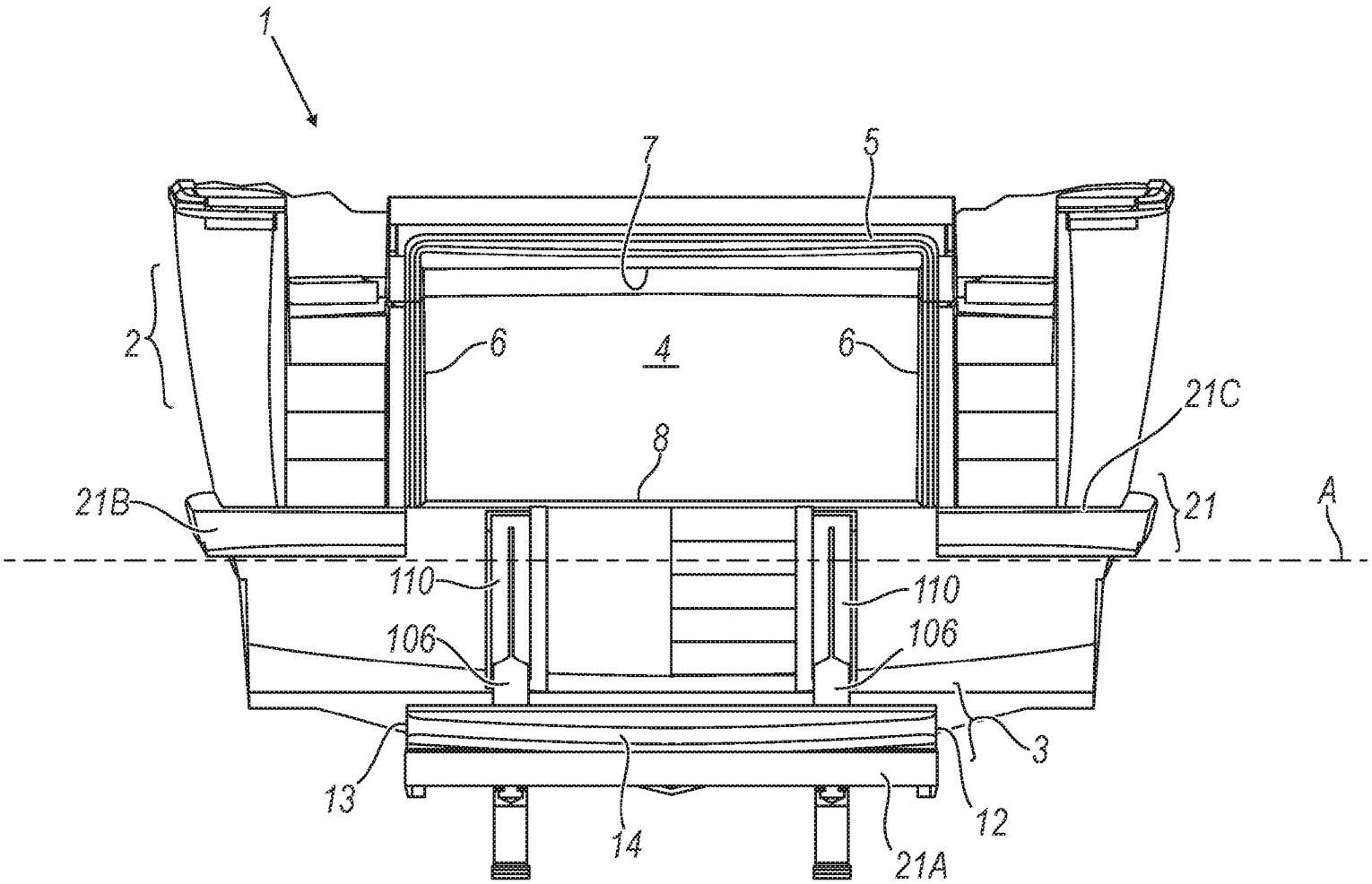
FIG. 7 shows a front view of the stern of the boat, its hatch being in the position depicted in FIG. 5.
Figure 8:
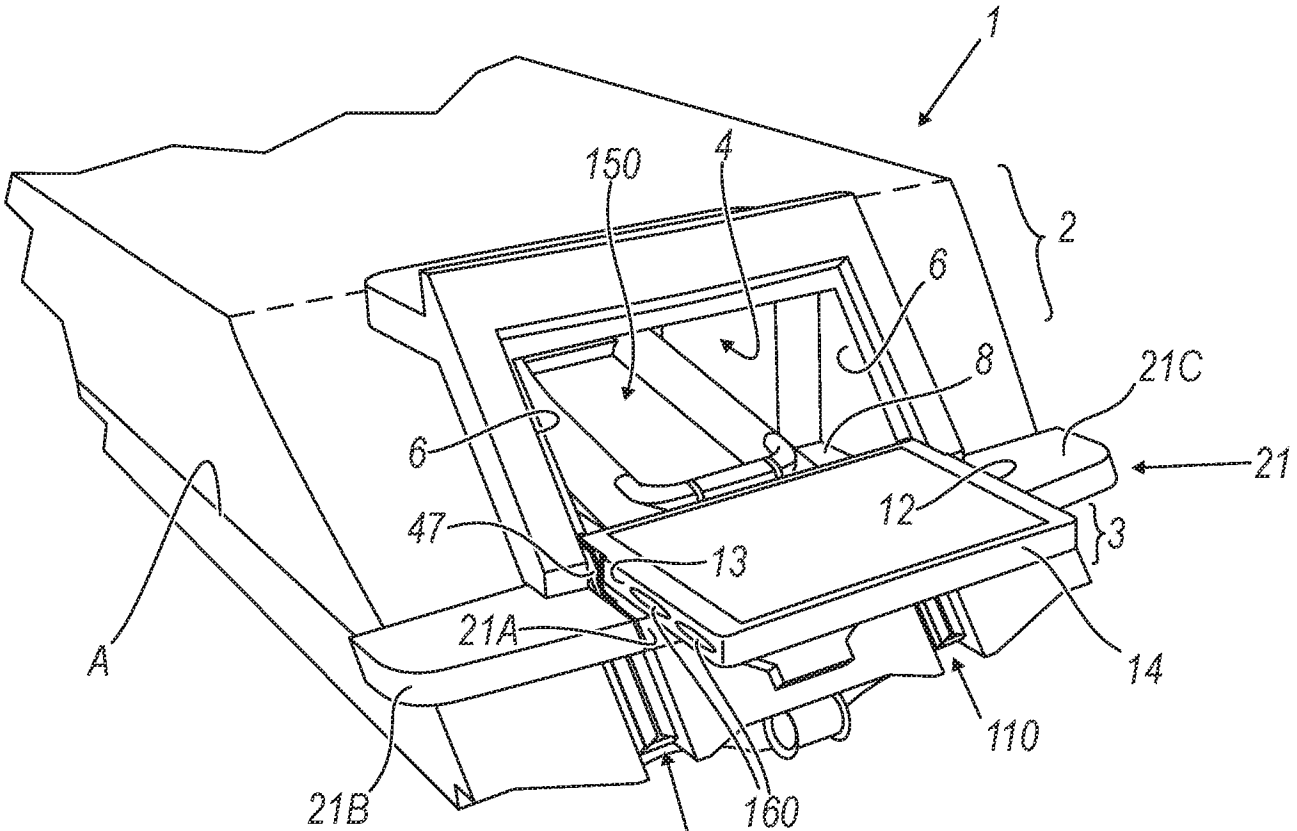
FIG. 8 shows a perspective view, from the stern, of a boat according to the invention in an initial step of a stern hatch opening operation suitable for allowing a dinghy or tender stored in a stern compartment of the boat to be put in the water.
Figure 9:
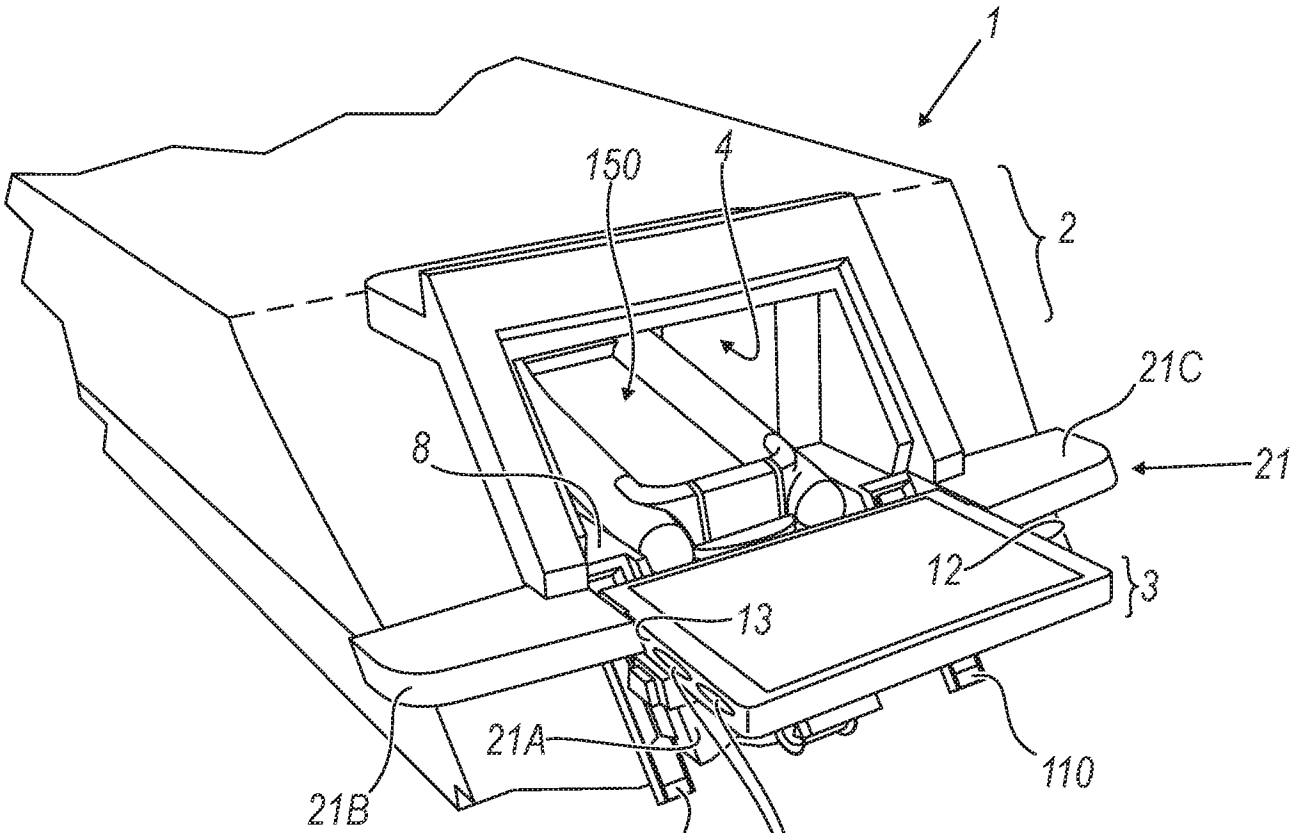
FIG. 9 shows a view similar to that of FIG. 8, the stern hatch being depicted in an instant in time during its lowering, aiming at making the coming out of the tender from the stern compartment easier.
Figure 10:
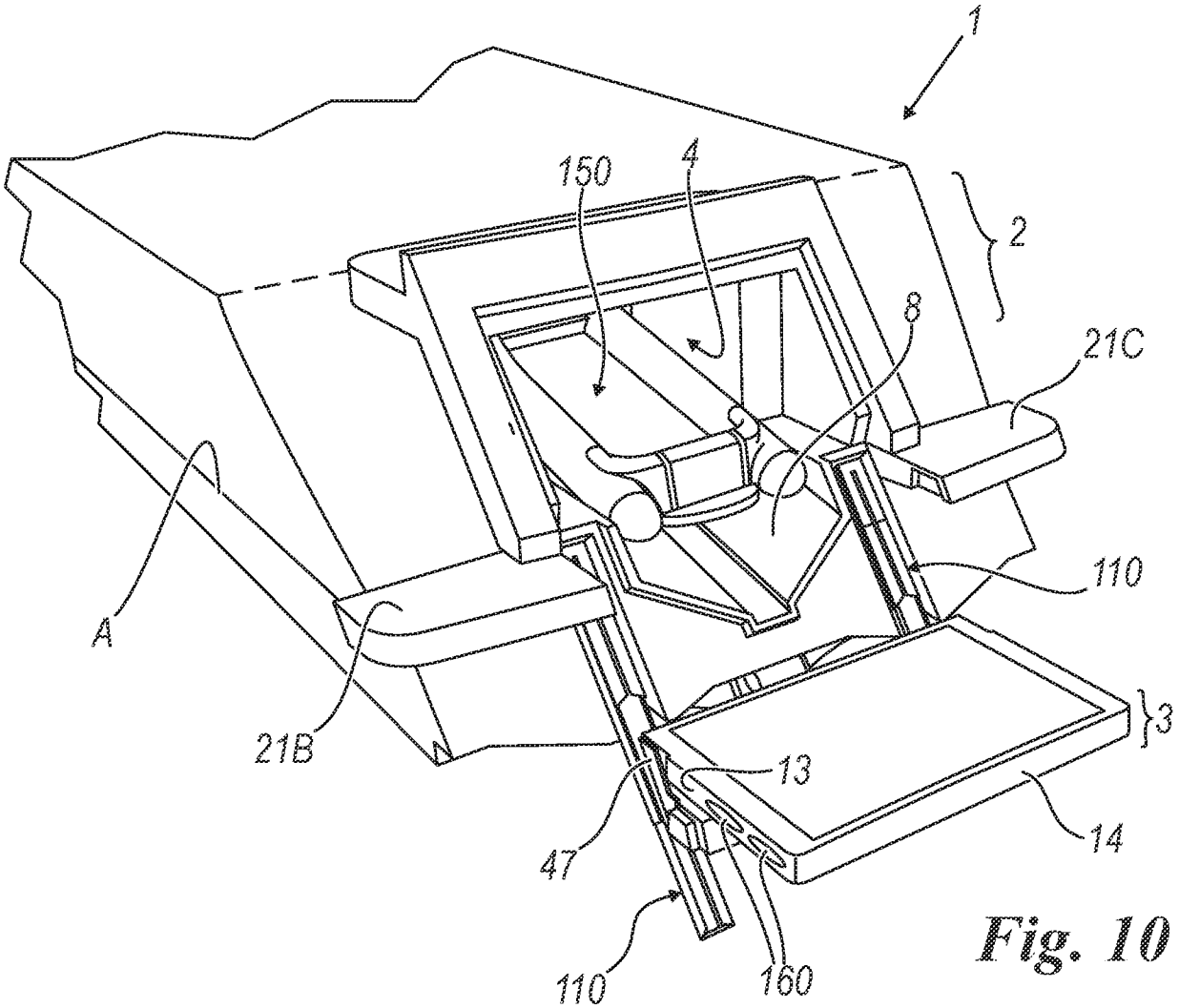
FIG. 10 shows a view similar to that of FIG. 9, the hatch being completely lowered down to let the tender go out of the stern compartment.
Figure 11:
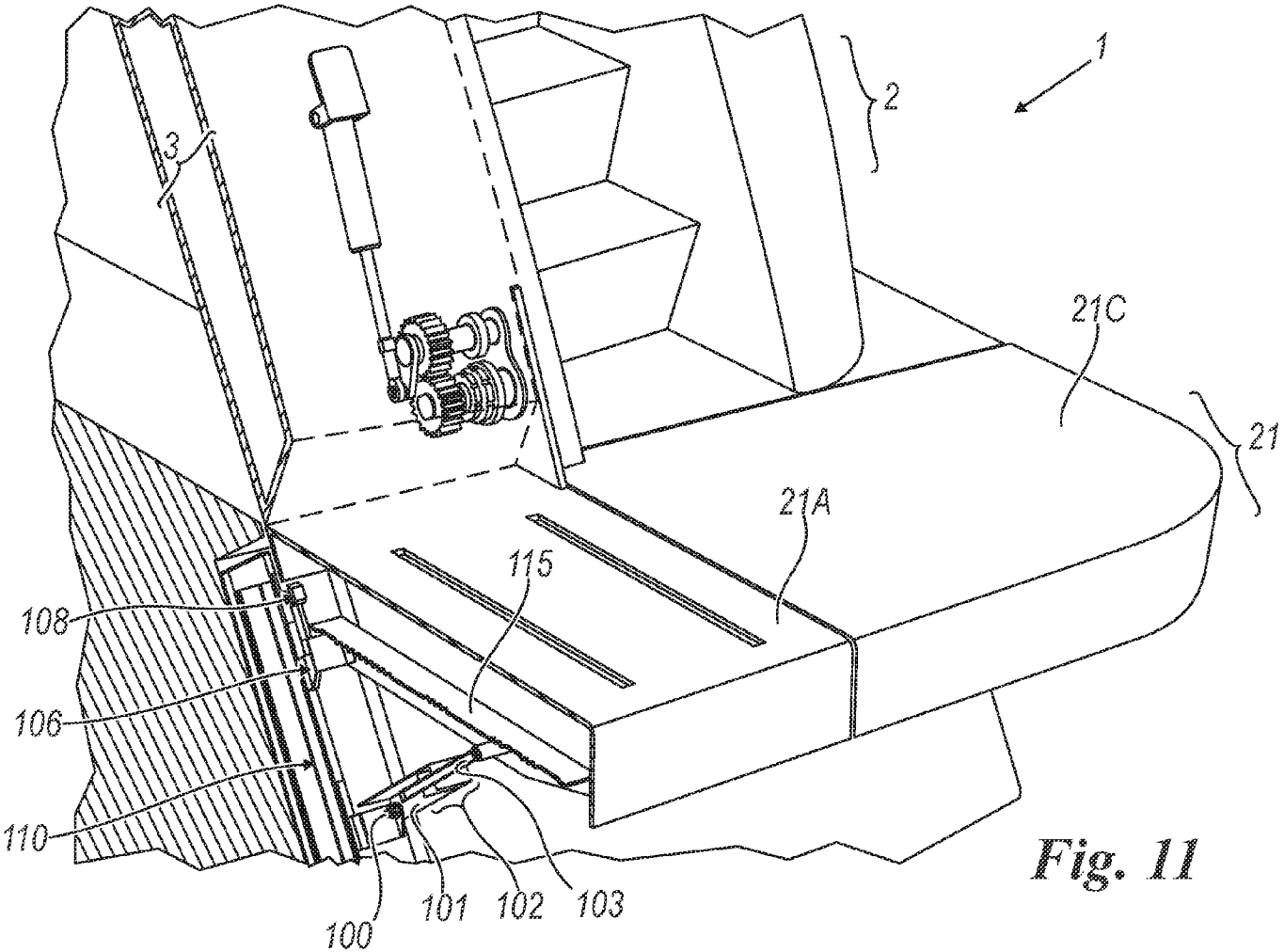
FIG. 11 shows a cross-sectional view according to line 11-11 of FIG. 1.

With reference to the mentioned figures, a boat 1 is (partially, in its stern portion only) shown as comprising a hull 2 having a stern hatch 3 suitable for enclosing a stern compartment 4, for instance suitable for housing a small boat like a dinghy or a tender (not shown in the figures). Such compartment 4 has an aperture 5, opposed side walls 6, an upper part 7, and a lower part 8.

The stern hatch 3 has an outer wall 10, an inner wall (generally made of fiberglass, for instance like the hull 2) spaced from each other by sides 12 and 13, upper and lower edges 14 and 15; such walls 10 and 11, said sides and 13, and the upper and lower edges 14 and 15 determine a body 20 of the hatch.

In the embodiment depicted in the figures, the hatch 3 is capable of opening toward a stern platform 21 of the hull 2, i.e. it is capable of opening downwards with respect to the compartment 4. Such platform 21 comprises a central portion 21A that is movable, i.e. suitable for being submerged in the water (on which the boat identified by A in the figures floats) with respect to side portions 21B and 21C. For instance, such movement is obtained by constraining, via a hinge 100, a stem 101 of a (hydraulic, pneumatic, or hydropneumatic) telescopic member 102, to the hull 2, whose stem 103 is hinged in 104 to the platform portion 21A, the latter being hinged in 105 to a movable carriage 106, via actuators (for instance telescopic members 108) constrained to such hull, along guides 110 integral with the latter. Said portion 21A features a part 115 which said member 103 and said carriage 106 connect to.

Alternatively, the position 21A is supported by telescopic guides having a fixed part (conceptually corresponding to the fixed guide 110) and a movable part (corresponding to the carriage 106), the movable part of said guides being operated in an intrinsically known (hydraulic, pneumatic, or hydropneumatic) way.

The outer wall 10 of the hatch is suitable for arranging itself in correspondence with a stern wall 26 of the boat 1 when the hatch is closed, said wall 26 delimiting the aperture 5 of the compartment 4.

According to the invention, the stern hatch 3 is associated with actuating means 30 located inside its body 20, in a gap 31 present between the inner wall 11 and the outer one 10; such means 30 make it possible the motion of the hatch with respect to the aperture 5 of the compartment 4 during the opening and closing operations and at the same time constrain said hatch to the latter, so as not to limit the amplitude of said compartment. This way, the hatch is not provided with any hinge members or further connections to the hull 2. It follows that mainly the side walls 6, but also the walls 7 and 8 of the compartment 4 do not support any hatch actuating means and the hatch is perfectly smooth on all of its sides. A further consequence is in that the hatch is not rigidly connected to the hull. All of this is to the advantage of safety for the people on board the boat 1, who can freely move inside the compartment 4 without any risks of hitting against parts projecting from its walls and also to the advantage of an ease operation in loading means or goods inside such compartment.

The actuating means 30 are enclosed, in the gap 31, within a container 120, comprising parts 121 fixed to the hatch 3 and a preferably removable cover 122 to access the inside of the container 120. The latter is closed watertight so as to prevent water from entering it, water that might otherwise corrode or however damage the actuating means 30 whenever the hatch 3 is submerged in the water, as it will be described below.

More specifically, the actuating means 30 comprise, in correspondence with at least one side 12, 13 and preferably both of them, should the dimensions and the weight of the hatch be not negligible, a pair of gearings 40 and 41 whose toothed surfaces 40A and 41A are suitable for cooperating with each other so as to allow a relative movement between said gearings. Specifically, the gearing or gear wheel 40 is fixed to a beveled shaft which is constrained, via an extremal flange 44 arranged in correspondence with a hole 45 present in said side 12, 13, to a support 47 like a panel constrained to the movable portion 21A of the stern platform 21, projecting toward the compartment 4 and located on each side 12, 13 of the hatch where the actuating means 30 are present. The shaft 43 is connected to the hatch 3 via other constraint elements, like flanges 430.

The gear wheel 40 is fixed whereas the gear wheel or gearing 41 can move along its toothed surface. Such a movement is generated by a pneumatically, hydraulically, or hydropneumatically movable telescopic member 50 comprising a stem 51 movable in a sleeve 52; the sleeve 52 is fixed, via a support or bracket 59 to a wall, for instance the outer one 10 (from the inside of the gap 31), of the hatch, whereas the stem 51 features a head 53 supporting a pin 54 (via an eyelet 55) eccentrically fixed to a body or connecting rod 56 integral with the gearing or gear wheel 41. Activating the telescopic member results in lowering or lifting the hatch.

Such telescopic member 50 is controlled by a control unit (not shown in the figures) outside the hatch, indicatively installed in the engine room and which the oil (or air) ducts originate from to subsequently reach the sleeve 52, for instance via the shaft 43 of the first gearing 40.

Such member can be electrically operated indeed.

Figure 12:
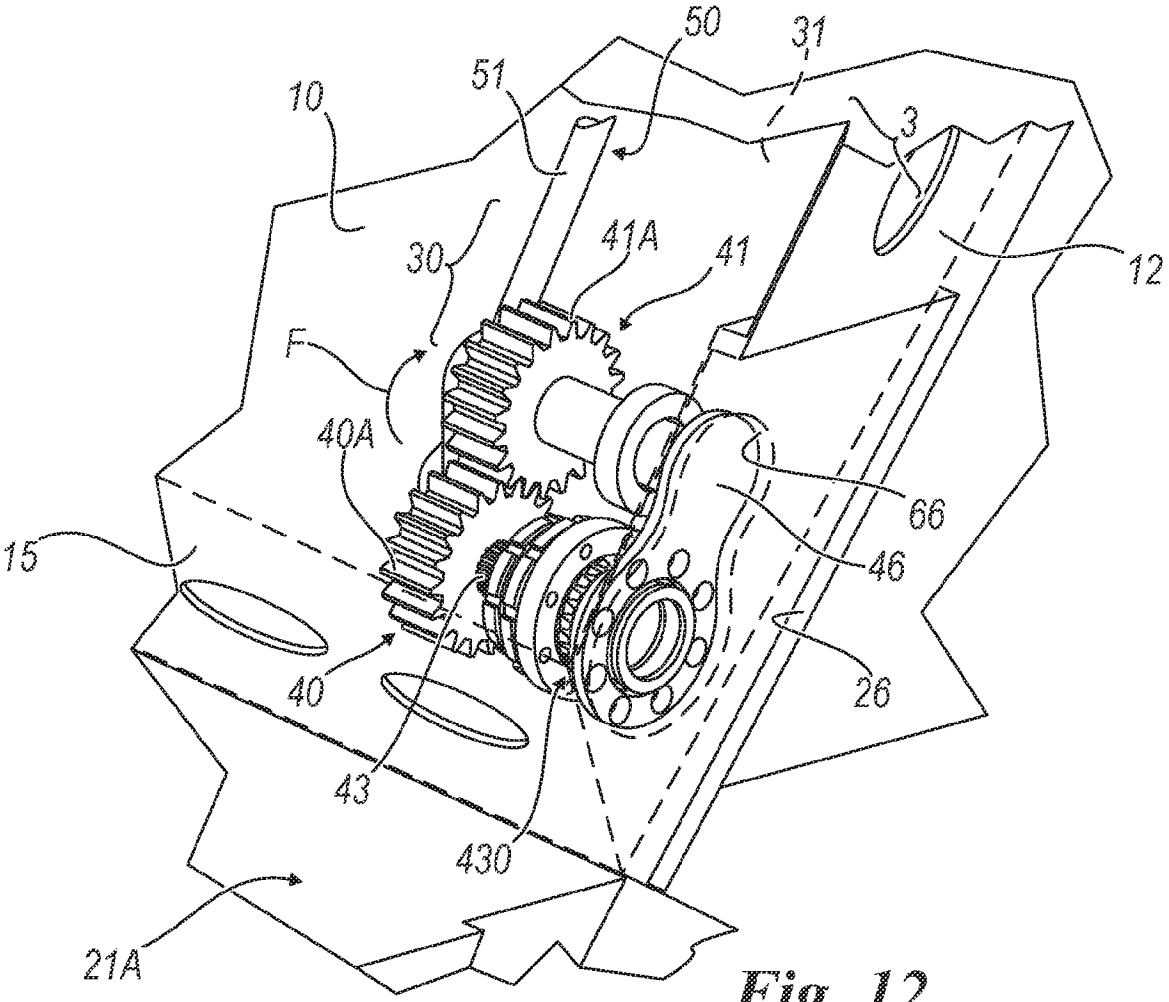
FIG. 12 shows a partial, transparent, side perspective view of FIG. 1 of a part of the hatch of the boat according to the invention highlighting part of the actuating means of the hatch itself.
Figure 13:
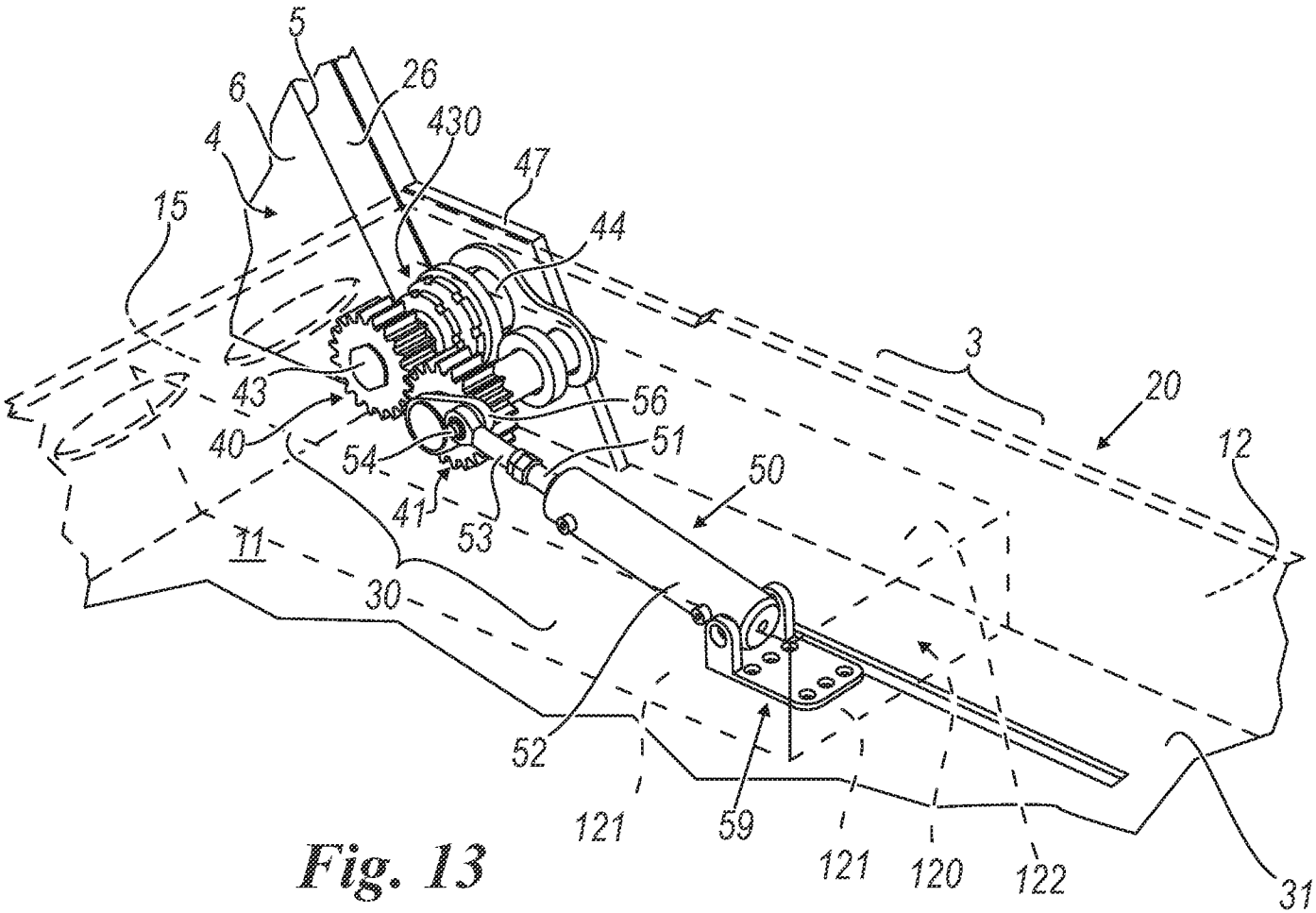
FIG. 13 shows a transparent, enlarged perspective view of the hatch in its open operating arrangement according to FIG. 2 highlighting the actuating means according to FIG. 12.
Figure 14:
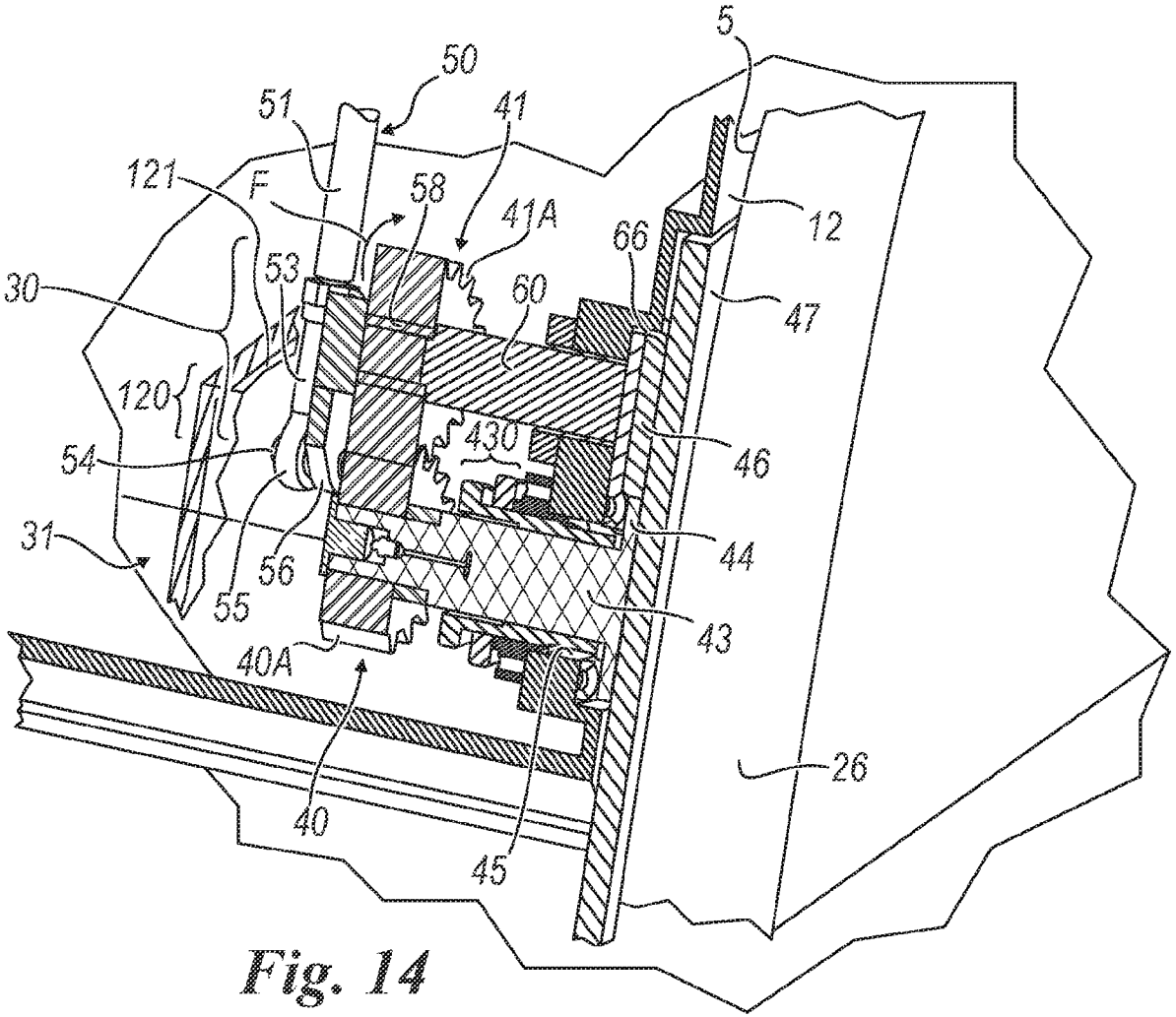
FIG. 14 shows a perspective view similar to that of FIG. 12, part of the hatch having been removed for the sake of clearness.

More specifically, starting from the position depicted in FIG. 1, if the stem 51 is retracted into the sleeve 52, then the connecting rod 56 rotates (clockwise in FIGS. 12 and 14, see arrow F) the gearing 41 onto the gearing 40, which results in lowering the hatch down. Vice versa, taking the stem 51 out of the sleeve 52 results in a rotation of the gearing 41 onto the gearing 40 that is reversed (with respect to the previous one, i.e. counterclockwise), which results in lifting the hatch 3 up to its closing positioning on the aperture 5 of the compartment 4.

The gearing 41 is rotatable via a bearing or an equivalent member 58 and is put on a shaft 60 projecting from a support 46 and integral therewith. Such support is put on the shaft 43 and can rotate around it thanks to appropriate mechanical decoupling members or bearings.

In particular, such support 46 is located in a hollow 66 created outside the adjacent side 12, 13 of the hatch 3 and is blocked therein by a form coupling with the hollow itself. This way, the movement of the gearing 41 on the gearing 40 forces the shaft 60, hence its support 46 and the complete hatch 3, to rotate around such gearing 41, which subsequently operates as a hinge for the hatch.

Thanks to the invention, the possibility is achieved of constraining the hatch to the hull of the boat (through the platform 21 or better the portion 21A thereof) without using any specially conceived hinge members and at the same time a hatch movement mode is offered which is fully encased therein, which leads to the advantages indicated above. The hatch according to the invention is therefore not rigidly connected to the boat. This allows to obtain movements of the hatch itself not possible in solutions according to the state of the art, like that described in the present text and relevant to the submersion of said hatch into the water.

Also, the complete movement mechanisms defined by the actuating means 30 can be pre-assembled, put in the container 120, and enclosed in the hatch, its constraint to the panel 47 being performed upon its final mounting on the boat 1. This reduces the mounting time as referred to that necessary with the known solutions.

The hatch 3 having been opened as described above, moving (i.e. lowering) the portion 21A of the stern platform in the direction to the water, so as to submerge it therein, makes the hatch 3 sink together with the platform.

As a matter of fact, thanks to the hatch 3 being constrained to the supports 47 (lateral with respect thereto) and since these supports are integral with the portion 21A of the platform, lowering the latter into the water results in lowering into such water the complete hatch 3 which, when open, leans on said platform. The hatch being sunk completely sets the aperture 5 of the compartment 4 free. In this way, should the latter be suitable for housing a tender or dinghy 150, this means can be simply lowered into the water (which, the hatch being sunk, can partially enter such compartment 4) and as simply hauled in the compartment 4.

For this purpose, the lower wall 8 has, in this solution, an inclined-plane configuration which facilitates the movement of the tender 150, obtained for instance through a usual winch fixed to an inner wall of the compartment 4 (not shown in the figures).

It is worth noting that the sunk hatch also operates as a support to board the tender or dinghy when it is already floating or to load equipment, for instance stub diving cylinders, thereon. In order to facilitate the access of people onto the sunk hatch, it might be worth to indicate that steps can be provided on the transom of the boat to facilitate the coming and going of guests to/from the submerged small beach determined by said hatch.

Water possibly enters the gap 31 of the hatch during submersion, which makes the lowering into water easier. For this purpose, on its sides 12, 13 and in the wall 15 one or several slots 160 are provided (the figures show, wherever possible, only those in the side 12 and in the wall 15) to let water go in. Such holes make also it possible for water to go out of the gap 31 when the hatch 3 goes out of the water.

Because of water entering the body 20 of the hatch 3, the actuating means 30 are closed watertight inside the container 120.

A specific embodiment of the invention has been described. However, others can be obtained, like that which comprises pumps inside the body 20 of the hatch 3 to remove the water entering it or actuating means 30 different from the telescopic member 50 or that which does not comprise any stern platform and the hatch moves along telescopic guides, like those which move the platform in the embodiment described in the figures, which the supports 47 are fixed to. Such solutions can be derived from the previous description and shall be deemed to fall within the scope of the following claims.

The invention claimed is:

1. A boat comprising a hull provided with a rear stern hatch located in correspondence with an internal stern compartment of said hull and suitable for opening and closing in correspondence with an aperture of said compartment, said hatch having a body with opposed side located in correspondence with side walls of said compartment and an upper edge and a lower edge, the hatch comprising a body internally to which there is a cavity, the boat comprising a stern platform, wherein said stern platform is at least partially movable with respect to the hull and is submersible into the water, actuators being provided to connect said at least partially movable stern platform to the hull and to move said at least partially movable platform into the water, the at least partially movable platform being connected to and supporting the hatch by means of panels integral with the at least partially movable stern platform and located in correspondence with corresponding opposite sides of the hatch, at least one of said panels being connected to a corresponding side of the hatch through actuating means suitable to move said hatch with respect to the aperture of the stern compartment, said actuating means located inside the cavity of the hatch body, said actuating means rotatably connecting said at least one of said sides of the hatch for allowing the hatch to open or close said aperture and to reach, upon opening, a position submerged in the water when the at least partly movable stern platform is submerged, no connection being provided between the sides of the hull and the side walls of the stern compartment.

2. A boat according to claim 1, wherein the stern platform comprises three adjacent portions, one portion interposed between the remaining two being movable and carrying the panels supporting the hatch.

3. A boat according to claim 1, wherein the actuators moving the at least partly movable stern platform comprise a first portion connected to the hull and a second portion movable with respect to said first portion fixed to the hull, to said second portion said at least partly movable platform being connected.

4. A boat according to claim 1, wherein the stern compartment is floodable, said compartment being suitable for housing a small boat.

5. A boat according to claim 1, wherein said actuating means comprise a first gearing or gear wheel on which a second gearing or gear wheel moves, the first gearing being fixed to said panels, the second gear wheel being integral with the hatch, an actuating member also located in the hatch cavity being connected to said second gearing.

6. A boat according to claim 5, wherein the second gearing supports a body to which a pin is eccentrically fixed, said pin being connected to said actuating member.

7. A boat according to claim 1, wherein said actuating means are watertightly enclosed in a container located in the hatch cavity.

8. A boat according to claim 1, wherein said actuating means comprise a telescopic member including a sleeve fixed to the body of the hatch and a movable stem having a head eccentrically connected to the body supported by the second gearing.

9. A boat according to claim 8, wherein said telescopic member is alternatively of a hydraulic, pneumatic, or hydro-pneumatic type.

10. A boat according to claim 8, wherein said telescopic member, alternatively of the hydraulic, pneumatic, or hydro-pneumatic type, is powered by a control unit installed outside the hatch.

11. A boat according to claim 5, wherein the second gearing is rotatably located on a shaft projecting from and integral with a support, said support being located on a shaft fixedly supporting the first gearing, said support being rotatable around said shaft of the first gearing and being integral with the adjacent side of the hatch.

12. A boat according to claim 11, wherein the support from which projects the shaft on which rotates the second gearing is inserted in a cavity provided in said side of the hatch, said cavity having the shape of said support.

13. A boat according to claim 1, wherein said at least partly movable stern platform is connected to a carriage movable along guides fixed to the hull.

* * * * *